US008878066B2

(12) United States Patent
Galletti et al.

(10) Patent No.: US 8,878,066 B2
(45) Date of Patent: Nov. 4, 2014

(54) POWER TRANSMISSION CABLE

(75) Inventors: Franco Galletti, Milan (IT); Eduardo Grizante Redondo, Milan (IT)

(73) Assignee: Prysmian S.p.A., Milan (IT)

( * ) Notice: Subject to any disclaimer, the term of this patent is extended or adjusted under 35 U.S.C. 154(b) by 721 days.

(21) Appl. No.: 12/448,069

(22) PCT Filed: Dec. 15, 2006

(86) PCT No.: PCT/EP2006/069755

§ 371 (c)(1),
(2), (4) Date: Oct. 30, 2009

(87) PCT Pub. No.: WO2008/071237

PCT Pub. Date: Jun. 19, 2008

(65) Prior Publication Data

US 2010/0051315 A1 Mar. 4, 2010

(51) Int. Cl.
*H01B 7/295* (2006.01)
*H01B 3/44* (2006.01)

(52) U.S. Cl.
CPC ..... *H01B 7/295* (2013.01); *H01B 3/447* (2013.01)
USPC ..... 174/120 R

(58) Field of Classification Search
USPC ..... 174/113 R, 120 R, 121 A
See application file for complete search history.

(56) References Cited

U.S. PATENT DOCUMENTS

| | | | | |
|---|---|---|---|---|
| 3,571,490 | A * | 3/1971 | Bunish et al. | 174/113 R |
| 4,098,762 | A | 7/1978 | Miyata et al. | |
| 4,145,404 | A | 3/1979 | Miyata et al. | |
| 4,547,626 | A | 10/1985 | Pedersen et al. | |
| 4,600,806 | A * | 7/1986 | Beretta | 174/121 A |
| 5,457,285 | A * | 10/1995 | Faust et al. | 174/23 R |
| 6,133,367 | A | 10/2000 | Arhart | |
| 6,501,027 | B1 | 12/2002 | Belli et al. | |
| 6,555,605 | B1 | 4/2003 | Casiraghi | |
| 6,998,536 | B2 * | 2/2006 | Barusseau et al. | 174/110 R |
| 7,132,604 | B2 * | 11/2006 | Scheidecker et al. | 174/110 R |
| 7,518,064 | B2 * | 4/2009 | Morioka et al. | 174/120 R |
| 2003/0066675 | A1 | 4/2003 | Belli et al. | |

FOREIGN PATENT DOCUMENTS

| | | | |
|---|---|---|---|
| EP | 0 831 120 | A1 | 3/1998 |
| EP | 0 780 425 | B1 | 2/2009 |
| JP | 2005-200536 | * | 7/2005 |

OTHER PUBLICATIONS

WESCO; Wire & Cable Catalog & Specifications; Electrical Cable, Power Cable, Power & Instrumentation Cable, Instrumentation Cable; Catalog and Specifications; pp. 4-14 (2004).

ANSI, American National Standards Institute, IEC 60092-359, "Electrical installations in ships—Part 359: Sheathing Materials for Shipboard Power Communications Cables," 1 page (1999).

* cited by examiner

*Primary Examiner* — Chau N Nguyen
(74) *Attorney, Agent, or Firm* — Finnegan, Henderson, Farabow, Garrett & Dunner, L.L.P

(57) ABSTRACT

A power transmission cable includes at least one power conductor, an insulating layer surrounding the conductor to form at least one insulated conductor, a flame-retardant halogen free protective sheath provided in a radially external position with respect to the insulated conductor, wherein the sheath has an inner and an outer layer in contact with each other, the inner layer having a thickness at least equal to a thickness of the outer layer, the inner layer including a polymer material having a glass transition temperature equal to or lower than −30° C., and the outer layer including a mud resistant polymer material.

21 Claims, 1 Drawing Sheet

POWER TRANSMISSION CABLE

CROSS REFERENCE TO RELATED APPLICATION

This application is a national phase application based on PCT/EP2006/069755, filed Dec. 15, 2006, the content of which is incorporated herein by reference.

FIELD OF THE INVENTION

The present invention relates to a power transmission cable for operating under chemically challenging conditions and at very low temperature.

Certain power cable applications, such as offshore, land rigs, marine vessels and oil and gas drilling rigs, require the cable to be protected by an external sheath suitable to withstand mechanical stresses and/or harsh environmental conditions.

Such power transmission cable sheath should complies with various requirements.

In view of the environmental conditions where such cables have to operate, a resistance to chemicals is required, such chemicals being, for example, sea water, hydrocarbons, oils, drilling fluids and mud. Power cable should be provided with a sheath chemically resistant to the attack of these substances, in accordance to national or international recommendation such as NEK (Norsk Elektroteknisk Komite) 606 or IEC 60092-359.

For health and safety reasons, such cables should qualify as low-smoke zero-halogen, i.e. the covering layers thereof, such as insulating layer and sheath should emit limited smoke and no chlorine (the halogen typically present in covering compounds) when exposed to sources of heat or fire.

Many applications find place in cold environment, as "cold" being intended temperatures below −30° C. or more. Such cables should be capable to maintain the mechanical characteristics requested by the use, e.g. flexibility and impact resistance, even at such low temperature.

DESCRIPTION OF RELATED ART

U.S. Pat. No. 4,547,626 discloses a cable which is said to have improved flame/fire and oil/abrasion resistant properties. The cable is halogen free since the conductor insulation and all sheaths are of the self-extinguishing type. The outer protective shield include a polyester tape winding and a self-extinguishing sheath, as well as an optional thin extruded sheath of nylon which effectively protects the cable core against abrasion and damaging hydrocarbons like oil and drilling mud. Whereas the optional outer oil and abrasion resistant layer of nylon is halogen free, the material in itself is combustible, but the layer is so thin (in order of 0.2-0.6 mm) that when placed on top of the self-extinguishing outer protective sheath it will not sustain a fire.

The Applicant observed that this outermost layer cannot effectively operate at low temperatures because the glass transition temperature of nylon is substantially higher than 0° C. So this layer is brittle and cracks at low temperatures, leaving the underlying layers without protection against the cited chemicals.

U.S. Pat. No. 6,133,367 discloses a flame and oil resistant thermoset composition comprising a blend of (a) 50-95 wt % relative to component (b) of an ethylene-vinyl acetate copolymer having a vinyl acetate percentage of about 18-60 wt %; and (b) 5-50 wt % of an ethylene-vinyl acetate-carbon monoxide terpolymer having a vinyl acetate percentage of 18-35 wt %; a CO percentage of 3-20 wt %; and (c) wire and cable acceptable excipients, wherein at least one cross-linking agent is included, and wherein a plasticizer is not required as an acceptable excipient.

The Applicant faced the problem of providing a power transmission cable with a sheath capable of withstanding chemical aggressions, especially from oil and drilling mud, and to preserve the mechanical characteristics, such as flexibility and impact resistance, at very low temperatures (below −30° C.).

SUMMARY OF THE INVENTION

The Applicant found that a power transmission cable may be effectively protected against aggressive chemicals and may be used even at very low temperatures by providing the cable with a flame-retardant halogen free sheath comprising an inner and an outer layer, the outer layer being resistant to chemicals and the inner layer being endowed with physical features such to withstand very low temperatures, said inner layer having a thickness at least equal to the thickness of said outer layer.

As used herein the following expressions have the following meanings:

"Drilling mud" means a fluid complex mixture used in oil and natural gas wells and in exploration drilling rigs. Drilling mud may include bentonite clay (gel) barium sulfate (barite) and hematite, or can be based on naphthenic compounds, esters, aromatic oils, olefins.

"Mud resistant" means the ability to withstand drilling mud as defined by proper recommendations such as NEK 606:2004.

"Glass transition temperature (Tg)" means the temperature below which a polymer changes from rubbery to glassy state. Such a temperature may be measured according to known techniques such as, for example, by Differential Scanning Calorimetry (DSC).

"Flame retardant halogen-free" indicates a material capable to prevent the spread of combustion by a low rate of travel so the flame will not be conveyed, said material having a halogen content lower than 5% by weight, as provided, for example, by IEC 60092-359 SHF2

DETAILED DESCRIPTION OF THE INVENTION

The invention relates to a power transmission cable comprising:

at least one power conductor;

an insulating layer surrounding said conductor to form at least one insulated conductor;

a flame-retardant halogen free protective sheath provided in a radially external position with respect to said insulated conductor;

wherein:

said sheath has an inner and an outer layer in contact one another, said inner layer has a thickness at least equal to the thickness of said outer layer, the inner layer comprises a polymer material having a glass transition temperature equal to or lower than −30° C.; and the outer layer comprises a mud resistant polymer material.

For the purpose of the present description and of the claims which follow, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

Advantageously, said inner layer has a thickness of at least 1.5 times the thickness of the outer layer, more preferably 2 times the thickness of the outer layer. The thickness of the inner layer can amount up to 20 times the thickness of the outer layer.

Preferably, said inner layer has a thickness of from 1.0 mm to 10.0 mm.

Preferably, the polymer material of the inner layer is selected from:

a) an alkylene/vinyl acetate copolymer or a mixture of alkylene/vinyl acetate copolymers having an average content of vinyl acetate comonomer of from 20 to 50% by weight with respect to the weight of the copolymer;

b) an alkylene/alkyl acrylate copolymer or a mixture of alkylene/alkyl acrylate copolymers having an average content of alkyl acrylate comonomer equal to or lower than 40% by weight with respect to the weight of the copolymer.

Preferably the alkylene comonomer of copolymer a) or of copolymer b) is ethylene comonomer.

More preferably, the average content of vinyl acetate comonomer in the copolymer a) is of from 30% to 40% by weight with respect to the weight of the copolymer.

Advantageously, the alkyl acrylate of copolymer b) is selected from methyl acrylate and butyl acrylate.

Preferably, the average content of alkyl acrylate comonomer in the copolymer b) is equal to or higher than 20% by weight with respect to the weight of the copolymer.

Preferably, the polymer material of the inner layer comprises from 40% to 80% by weight with respect to the weight of the polymer material of a flame-retardant filler.

Preferably the flame-retardant filler is selected from inorganic salts, oxides, hydroxides or mixture thereof. Magnesium hydroxide [$Mg(OH)_2$], aluminium hydroxide [$Al(OH)_3$], magnesium carbonate ($MgCO_3$) and the mixtures thereof are preferred.

The magnesium hydroxide can be of natural origin, for example obtained by grinding a mineral such as brucite, or of synthetic origin.

As used herein as "synthetic magnesium hydroxide" is intended a magnesium hydroxide in form of flattened hexagonal crystallites substantially uniform both in size and morphology. Such a product may be obtained by various synthetic routes involving the addition of alkalis to an aqueous solution of a magnesium salt and subsequent precipitation of the hydroxide by heating at high pressure (see for example U.S. Pat. No. 4,098,762 or EP-780,425 or U.S. Pat. No. 4,145,404).

The polymer material of the inner layer can comprise additives such as thermal and oxidative stabilizing agents, peroxides, antioxidants, resin modifiers and the like.

Preferably said outer layer has a thickness of from 0.5 mm to 5.0 mm.

Preferably the polymer material of the outer layer is an alkylene/alkyl acrylate copolymer or a mixture of alkylene/alkyl acrylate copolymers having an average content of alkyl acrylate comonomer equal to or higher than 40% by weight with respect to the weight of the copolymer/s.

More preferably, the average content of alkyl acrylate comonomer is equal to or higher than 50% by weight with respect to the weight of the copolymer/s. The average content alkyl acrylate comonomer can amount to 80% by weight with respect to the weight of the copolymer/s.

Preferably the alkylene comonomer of copolymer is an ethylene comonomer.

Advantageously the alkyl acrylate comonomer is selected from methyl acrylate and butyl acrylate.

Advantageously, the polymer material of the outer layer has a Tg equal to or lower than −20° C.

In a preferred embodiment the outer layer comprises a flame retardant filler. The kind and amount of said filler can be similar to those of the flame retardant filler of the inner layer.

In a preferred embodiment, the cable of the present invention comprises a tape provided in a radially internal position with respect to the sheath. Advantageously said tape is helically wound around the insulated conductor so as to have overlapping coils. In other words, no interstices are provided such to put the inner layer and the underlying layers into contact.

Advantageously, said tape is made of a material selected from polyamide and polyester.

Advantageously, said tape is in form of textile material, preferably embedded in a polymeric matrix.

Preferably, the polymeric matrix where the textile tape is embedded in is based on an elastomeric polymer, for example selected from natural rubber (NR), styrene-butadiene rubber (SBR), butyl rubber (BR), ethylene propylene diene monomer rubber (EPDM), ethyl vinyl acetate rubber (EVA).

These and further features of the invention will become apparent from FIG. 1 shown herein below and from the subsequent examples.

Figure 1:
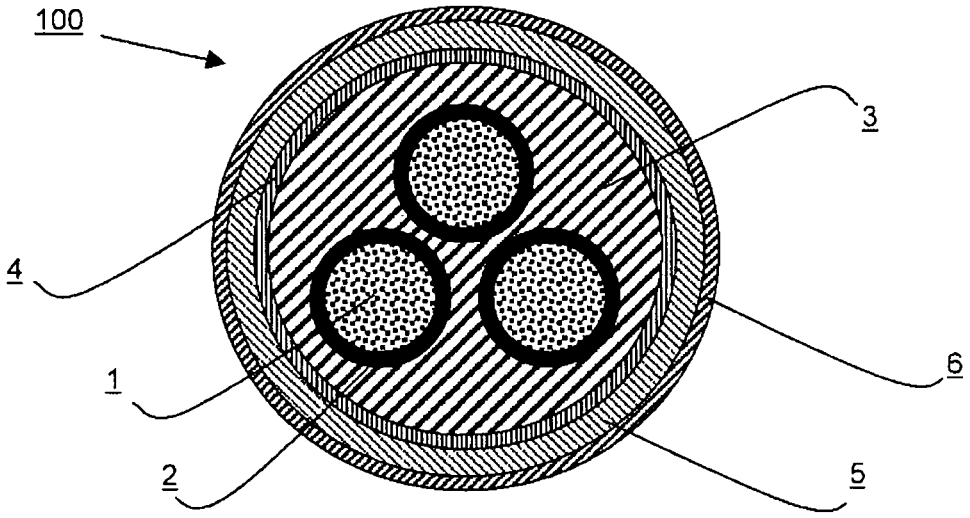
FIG. 1 shows a cross-section of a power transmission cable according to a first embodiment of the invention.

Cable 100 of FIG. 1 is a medium-voltage and comprises three conductors 1, each surrounded by an insulating layer 2 to provide three insulated conductors 1,2.

The term "medium voltage" indicates a voltage of from 1 kV to 35 kV.

The insulated conductors 1,2 stranded together and, optionally wrapped by a tape, e.g. in paper or textile material (not shown).

The twisting of the insulated conductors 1,2 gives rise to a plurality of voids, i.e. interstitial zones, which, in a transverse cross section along the longitudinal length of the strand, define an external perimeter profile of the latter of non-circular type.

Therefore, in order to allow the correct application of the radially external layers in a position radially external to said stranding, a bedding 3 a polymeric material (for example, an elastomeric mixture), is applied by extrusion to fill said interstitial zones so as to confer to the stranding a substantially even transverse cross section, preferably of the circular type.

In the presently depicted cable 100, the bedding 3 is surrounded by an armour 4, for example in form of copper braids, or in polymeric textile material.

The armour 4 of FIG. 1 is in turn surrounded by a sheath comprising an inner layer 5 and an outer layer 6.

Figure 2:
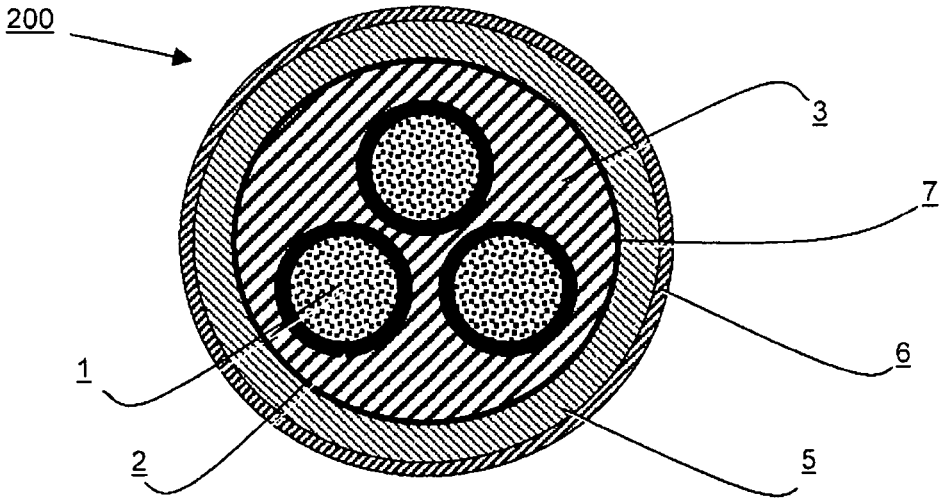
FIG. 2 shows a cross-section of a power transmission cable according to a second embodiment of the invention.

The cable 200 of FIG. 2 is similar to that of FIG. 1, thus the same reference number are used for the shared components thereof. Cable 200 lacks an armour.

The sheath of cable 200 comprises an inner layer 5, an outer layer 6 and a tape 7 provided in a radially internal position with respect to the inner layer 5. In the present case, the tape 7 is provided to surround the bedding 3.

The inner layer 5 and the outer layer 6 are in close contact one another. This close contact is preferably obtained by extrusion of the outer layer 6 on the inner layer 5 or by co-extrusion of a sheath formed by an inner layer 5 and an outer layer 6.

Example 1 and Comparative Example 2

The inner layer of a power transmission cable according to the invention was obtained by extrusion of a polymer composition according to Table 1.

TABLE 1

| Ingredients | phr | Percent by weight |
|---|---|---|
| ELVAX 40 ® L-03 | 50.0 | 24.2 |
| ELVAX ® 265 | 47.0 | 22.8 |
| HYDROFY ® GS 1.5 | 34.0 | 16.5 |
| MARTINAL ® OL 107 LE | 67.0 | 32.5 |
| Antioxidant agent | 1.5 | 0.7 |
| Peroxide | 2.2 | 1.1 |
| Other additives | 4.5 | 2.2 |
| Total | 206.2 | 100.0 |

Elvax ® 40L-03 = ethylene/vinyl acetate copolymer with a vinyl acetate comonomer content of 40% by weight; glass transition temperature of −32° C. (marketed by DuPont);
Elvax ® 265 = ethylene/vinyl acetate copolymer with a vinyl acetate comonomer content of 28% by weight; glass transition temperature of −5° C. (marketed by DuPont);
Hydrofy ® G-1.5 = natural magnesium hydroxide powders obtained by grinding brucite, marketed by Nuova Sima Srl;
Martinal ® OL-107 LE = aluminium hydroxide, marketed by Albemarle;

The admixture of the two ethylene/vinyl acetate copolymers provided a mixture having an amount of vinyl acetate comonomer of 35% by weight and a glass transition temperature of −34° C.

The inner layer of a power transmission cable provided as comparison was obtained by extrusion of a polymer composition according to Table 2.

TABLE 2

| Ingredients | Phr | Percent by weight |
|---|---|---|
| LEVAPREN ®600 HV | 100.0 | 47.6 |
| HYDROFY ® GS 1.0 | 32.9 | 15.6 |
| MARTINAL ® OL 107 LE | 67.1 | 31.9 |
| Antioxidant agent | 1.4 | 0.70 |
| Peroxide | 5.5 | 2.6 |
| Other additives | 3.4 | 1.6 |
| Total | 210.3 | 100.0 |

Levapren ®600 HV = ethylene/vinyl acetate copolymer with a vinyl acetate comonomer content of 60% by weight; glass transition temperature of −26° C. (marketed by Lanxess);
Hydrofy ® G-1.0 = natural magnesium hydroxide powders obtained by grinding brucite, marketed by Nuova Sima Srl;
Martinal ® OL-107 LE = aluminium hydroxide, marketed by Albemarle.

Example 3 and Comparative Example 4

The outer layer of a power transmission cable according to the invention was obtained by extrusion of a polymer composition according to Table 3.

TABLE 3

| Ingredients | Parts by weight | Percent by weight |
|---|---|---|
| VAMAC ® DP | 95.0 | 41.1 |
| KISUMA 5-A | 60.0 | 26.0 |
| MARTINAL ® OL 107 LE | 60.0 | 26.0 |

TABLE 3-continued

| Ingredients | Parts by weight | Percent by weight |
|---|---|---|
| Antioxidant | 1.4 | 0.60 |
| Peroxide | 2.4 | 1.0 |
| Other additives | 8.4 | 5.3 |
| Total | 230.9 | 100.0 |

Vamac ® DP = ethylene/methyl acrylate copolymer with a content of methyl acrylate comonomer of 58% by weight; glass transition temperature of −29° C. (marketed by DuPont);
Kisuma ® 5-A = precipitated magnesium hydroxide (marketed by Kyowa Chemical Industry);
Martinal ® OL-107 LE = aluminium hydroxide, marketed by Albemarle.

The outer layer of a power transmission cable provided as comparison was obtained by extrusion of a polymer composition according to Table 4.

TABLE 4

| Ingredients | Parts by weight | Percent by weight |
|---|---|---|
| Levapren ® 800 HV | 100.0 | 32.5 |
| Brucite SFP + MARTINAL ® OL104 LE | 130.0 | 42.2 |
| Frimiz MZ-1 | 69.8 | 22.6 |
| antioxidant | 1.0 | 0.4 |
| peroxide | 2.5 | 0.8 |
| Other additives | 4.7 | 1.5 |
| Total | 308.0 | 100.0 |

Levapren ® 800 HV: ethylene/vinyl acetate copolymer with a vinyl acetate comonomer content of 80% by weight; glass transition temperature of −3° C. (marketed by Lanxess);
Brucite SFP: natural magnesium hydroxide obtained by grinding brucite
Martinal ® OL-104 LE = aluminium hydroxide (marketed by Albemarle)
Frimiz MZ-1 = magnesium carbonate (marketed by Alpha Calcit Fullstoff GmbH & CO).

Example 5

Three cables were manufactured with a sheath composed by an inner layer 3.0 mm-thick and an outer layer 1.5 mm-thick, said inner and outer layer being as follows:

Cable 1: inner layer of Example 1 and outer layer of Example 3;

Cable 2: inner layer of Example 1 and outer layer of Example 4;

Cable 3: inner layer of Example 2 and outer layer of Example 3.

Cables 1 is according to the invention, while Cables 2 and 3 are provided as comparison.

Each cable was tested according to CSA (Canadian Standards Association) C22.2 No. 0.3-01 (2001) to check the cable response at an impact of a hammer head (weight=1.36 kg) after cooling to −40° C. for 4 hours.

After the test, Cable 1 according to the invention showed no cracks or ruptures. The polymeric material of the inner layer has a glass transition temperature such to confer the layer the capability to absorb the impact exerted on the sheath without damages to the outer layer made of a polymeric material with a higher glass transition temperature.

Cable 2, wherein the inner layer of the sheath is made of a polymer material having a glass transition temperature lower than −30° C. (Example 1), but the outer layer has a glass transition temperature higher than −20° C. (Example 4), showed cracks in the outer layer after the impact test. This result indicates that in spite of the presence of an inner layer with a very low glass transition temperature, the outer layer of the sheath cannot stand the impact when said outer layer is made of a material with a glass transition temperature just below 0° C. as a consequence, a cable like Cable 2 cannot be used, for example, in drilling activities located in very cold environment, because the cracks of the mud-resistant outer layer let the inner layer (not mud-resistant) prone to the chemical attack of the mud.

Cable 3, wherein the outer layer of the sheath is made of a polymeric material having has a glass transition temperature lower than −20° C. (Example 3), but the inner layer is made of a polymeric material having a glass transition temperature higher than −30° C. (Example 4), showed cracks and ruptures in both the layers. This result indicates that when an outer layer with a low glass transition temperature is not supported by an inner layer suitable for retaining the mechanical characteristic thereof at very low temperatures, said outer layer cannot withstand impact at such temperatures, thus depriving the inner layer (and other layers provided in a radially internal position) of the protection against the chemical attack of the mud. Again, a cable as Cable 3 cannot be used, for example, in drilling activities located in very cold environment, because the cracks of the mud-resistant outer layer let the inner layer (not mud-resistant) prone to the chemical attack of the mud.

The invention claimed is:

1. A power transmission cable comprising:

at least two power conductors;

an insulating layer surrounding each power conductor to form at least two insulated conductors;

a bedding layer surrounding the at least two insulated power conductors; and a flame-retardant halogen free protective sheath provided in a radially external position with respect to said bedding layer, wherein:

said sheath has a polymer material inner layer in contact with a polymer material outer layer, said inner layer has a thickness at least equal to a thickness of said outer layer, the polymer material of the inner layer has a glass transition temperature equal to or lower than −30° C.;

wherein the polymer material of the outer layer is mud resistant, wherein the polymer material of the outer layer is either an alkylene/alkyl acrylate copolymer or a mixture of alkylene/alkyl acrylate copolymers, wherein the polymer material of the outer layer has an average content of alkyl acrylate comonomer equal to or higher than 40% by weight with respect to the weight of the copolymer or copolymers, and wherein the polymer material of the outer layer has a glass transition temperature, Tg, equal to or lower than −20° C.

2. The power transmission cable according to claim 1, wherein said inner layer has a thickness of at least 1.5 times the thickness of the outer layer.

3. The power transmission cable according to claim 2, wherein said inner layer has a thickness 2 times the thickness of the outer layer.

4. The power transmission cable according to claim 1, wherein said inner layer has a thickness of 1.0 mm to 10.0 mm.

5. The power transmission cable according to claim 1, wherein the polymer material of the inner layer is selected from:

a) an alkylene/vinyl acetate copolymer or a mixture of alkylene/vinyl acetate copolymers having an average content of vinyl acetate comonomer of 20 to 50% by weight with respect to the weight of the copolymer; and b) an alkylene/alkyl acrylate copolymer or a mixture of alkylene/alkyl acrylate copolymers having an average content of alkyl acrylate comonomer equal to or lower than 40% by weight with respect to the weight of the copolymer.

6. The power transmission cable according to claim 5, wherein the alkylene of copolymer a) or of copolymer b) is an ethylene comonomer.

7. The power transmission cable according to claim 5, wherein the content of vinyl acetate comonomer in copolymer a) is 25% to 45% by weight with respect to the weight of the copolymer.

8. The power transmission cable according to claim 5, wherein the alkyl acrylate of copolymer b) is selected from methyl acrylate and butyl acrylate.

9. The power transmission cable according to claim 5, wherein the content of alkyl acrylate comonomer in the copolymer b) is equal to or higher than 20% by weight with respect to the weight of the copolymer.

10. The power transmission cable according to claim 1, wherein the polymer material of the inner layer comprises 40% to 70% by weight, with respect to the weight of the polymer material, of a flame-retardant filler.

11. The power transmission cable according to claim 10, wherein the flame-retardant filler is selected from inorganic oxides and hydroxides or mixture thereof.

12. The power transmission cable according to claim 11, wherein the flame-retardant filler is selected from magnesium hydroxide, aluminium hydroxide and mixtures thereof.

13. The power transmission cable according to claim 1, wherein said outer layer has a thickness of 0.5 mm. to 5.0 mm.

14. The power transmission cable according to claim 1, wherein the average content of alkyl acrylate comonomer is equal to or higher than 50% by weight with respect to the weight of the copolymer or copolymers.

15. The power transmission cable according to claim 1, wherein the alkylene is an ethylene comonomer.

16. The power transmission cable according to claim 1, wherein the alkyl acrylate comonomer is selected from methyl acrylate and butyl acrylate.

17. The power transmission cable according to claim 1, having a tape provided in a radially internal position with respect to the sheath.

18. The power transmission cable according to claim 17, wherein said tape comprises a textile material.

19. The power transmission cable according to claim 18, wherein said textile material is embedded in a polymeric matrix.

20. The power transmission cable according to claim 19, wherein the polymeric matrix is based on an elastomeric polymer.

21. The power transmission cable according to claim 17, wherein said tape is made of a material selected from polyamide and polyester.

* * * * *